US006318131B1

(12) United States Patent
Kobata et al.

(10) Patent No.: US 6,318,131 B1
(45) Date of Patent: Nov. 20, 2001

(54) METHOD OF KNITTING 3-D SHAPE KNIT FABRIC

(75) Inventors: Yoshiyuki Kobata; Syunichi Nakai, both of Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 0 days.

(21) Appl. No.: 09/807,984

(22) PCT Filed: Nov. 4, 1999

(86) PCT No.: PCT/JP99/06178

§ 371 Date: May 1, 2001

§ 102(e) Date: May 1, 2001

(87) PCT Pub. No.: WO00/28121

PCT Pub. Date: May 18, 2000

(30) Foreign Application Priority Data

Nov. 10, 1998 (JP) ..... 10-319167

(51) Int. Cl.[7] ..... D04B 1/22
(52) U.S. Cl. ..... 66/64; 66/75.1
(58) Field of Search ..... 66/60 R, 64, 70, 66/71, 76, 77, 75.1, 73, 67, 169 R, 170, 175, 176, 177

(56) References Cited

U.S. PATENT DOCUMENTS 5,388,430 * 2/1995 Essig ..... 66/64
5,577,398 * 11/1996 Jeffcoat ..... 66/64
5,722,262 * 3/1998 Proctor et al. ..... 66/60 R
5,749,247 * 5/1998 Jeffcoat ..... 66/70
6,116,057 * 9/2000 Roell ..... 66/70
6,233,976 * 5/2001 Roell ..... 66/70

FOREIGN PATENT DOCUMENTS 4027606 3/1992 (DE) .
19171415 10/1998 (DE) .
522778 1/1993 (EP) .

* cited by examiner

*Primary Examiner*—Danny Worrell
(74) *Attorney, Agent, or Firm*—Arent Fox Kintner Plotkin & Kahn PLLC

(57) ABSTRACT

A three-dimensional shape fabric is knitted by the method in which after a setup portion of the three-dimensional shape fabric is formed by use of needles of the both front and back needle beds, a non-rectangular front fabric and a non-rectangular back fabric are knitted by performing a flechage knitting in which a first part of the front fabric and a first part of the back fabric are varied in number of courses from one wale to another so as to put a part of loops into a rested state in the process in which the front fabric knitted in association with the front needle bed and the back fabric knitted in association with the back needle bed are knitted in parallel to each other by use of different cam systems and then loops of the next parts following the forming of loops of final courses of the previously formed parts including the part of the loops as were put in the rested state are formed to join the parts to each other, the knitting process of which is repeated performed, and the loops of the final course of a final part of the front fabric and the loops of the final course of a final part of the back fabric are superposed on each other to perform a bind-off process.

2 Claims, 8 Drawing Sheets

METHOD OF KNITTING 3-D SHAPE KNIT FABRIC

TECHNICAL FIELD

The present invention relates to a method of a three-dimensional shape fabric requiring no post-treatment after completion of knitting by using a flat knitting machine including at least a pair of front and back needle beds, either or both of which is/are movable in a lateral direction thereof.

BACKGROUND ART

Various knitting methods for knitting a fabric in the form of a nearly finished product on the flat knitting machine to eliminate or relieve the need of the post-treatment after completion of the knitting are now under study, which are called "the shaping knit". Generally known shaping knits include, for example, (i) a knitting method in which while a front body portion is knitted, the widening or narrowing is performed to change the knitting width so as to correspond in configuration to a dress pattern, or a pocket is formed in the front body portion, so as to relieve the post-treatment after completion of the knitting, which is called "the integral garment", and (ii) a knitting method in which after front and back bodies and right and left sleeves are each knitted in the form of tube in adjacent regions, the sleeves are moved toward the bodies at the armpits and are joined thereto by repetition of the knitting step that loops of the sleeves are superposed on loops of the bodies at the sleeve sides so as to form the loops in the next courses, followed by the knitting step that the final courses of the front and back bodies are joined in the shoulders, whereby a fabric of a nearly completed product is knitted, which is called "the no-seam fabric". Further, another method of the shaping knit is known, which is called "the flechage knitting", in which in the knitting of a fabric, needles associated with a part of a knitting region are put into the rested state and a yarn feeder is reversed on the way in the knitting region to form loops at only a part of the needles and then loops of the next courses are formed on the loops retained at the needles as are in the rested state as well as on the loops retained at the needles as are put in the rested state after completion of the knitting in the other knitting region, so that the number of courses are varied between the wale in the rested state and the wale in the region in which the loops are continuously formed to allow a portion of the fabric having an increased number of courses to project in a convex form, whereby desired undulations are formed in the fabric.

German patent specification No. DE 3937406C2 discloses a knitting method of making use of flechage knitting to form a three-dimensional knitted article. DE 3937406C2 discloses that after the setup, the fabric is branched off back and forth, and one of the branched fabrics is put into the rested state, keeping the loops formed by the setup in their retained state. Then, the other needle bed is used and the other of the branched fabrics is knitted by the flechage knitting at both lengthwise end portions of the other needle bed, so as to form a part. Further, a next part to the previously formed part is knitted by the same flechage knitting to join that part to the previously formed part. Subsequently, the next part to the part formed by the flechage knitting is further knitted by the flechage knitting, whereby that part is joined to the previously formed part. This knitting is repeatedly performed in order, to join the parts to each other, to thereby produce a generally spherical knitted fabric. Then, after the loops of the final course of the one fabric as were kept in the rested state after the setup and the loops in the final course of the fabric of the part that is continuously knitted while it is joined to the previously formed part are joined, the bind-off process is performed. This method provides the advantages that the number of times and the locations of the flechage knitting can be selectively changed in accordance with the configuration of the fabric in which the flechage is formed, to knit a fabric of a desired configuration and that the setup portion and the finishing portion of the knitted fabric can be joined in the process of knitting. The knitting method disclosed by DE3937406C2 has however the disadvantage that the fabric which is put in the rested state after the knitting of the setup portion is being kept in the condition in which the loops formed by the knitting the setup portion are retained by the related needles until they are superposed on the loops of the final course of the other fabric and, as a result of this, a downward tensile force is exerted on the same loops for a long while. Thus, there is the possibility that the loops may be stretched while the other fabric is knitted or yarn breakage may occur and the resultant drop stitch may occur.

It is the object of the present invention to disclose the knitting method of three-dimensional shape fabric having undulation formed in the fabric by the flechage knitting that can provide improved efficiency in the knitting and also can prevent a downward tensile force from being exerted on the same loops for a long while, unlike the conventional knitting method, to prevent loop stretch and yarn breakage.

DISCLOSURE OF THE INVENTION

In view of the disadvantages above, the present invention provides a knitting method of a three-dimensional shape fabric whose front fabric and back fabric are knitted by use of a flat knitting machine, which comprises at least a pair of front and back needle beds, either or both of which are movable in a lateral direction thereof, and a plurality of cam systems, to transfer loops between the front needle bed and the back needle bed, and are joined at setup portions thereof and finishing portions thereof, the knitting method of the three-dimensional fabric comprising: the step of forming the setup portion of the three-dimensional shape fabric by use of needles of the both front and back needle beds; the step of knitting a non-rectangular front fabric and a non-rectangular back fabric by performing a flechage knitting in which a first part of the front fabric and a first part of the back fabric are varied in number of courses from one wale to another so as to put a part of loops into a rested state in the process in which the front fabric knitted in association with the front needle bed and the back fabric knitted in association with the back needle bed are knitted in parallel to each other by use of different cam systems; the step of forming loops of the next parts following the forming of loops of final courses of the previously formed parts including the part of the loops as were put in the rested state, so as to join the parts to each other; and the step of superposing the loops of the final course of a final part of the front fabric and the loops of the final course of a final part of the back fabric on each other to perform a bind-off process. According to the construction of the present invention, after the knitting of the setup portions of the front and back fabrics, the front fabric and the back fabric are knitted while they are kept in the condition of being overlapped back and forth and also the parts continuously formed by the flechage knitting are joined to each other and the final course of the front fabric and the final course of the back fabric are joined to each other, so that the three-dimensional shape fabric requiring no post-treatment after completion of the knitting can be knitted. When cam systems with different carriages are used for the knitting of the front fabric and the back fabric, both of the front fabric and the back fabric can be knitted in one operation of the carriage.

In the present invention, an interlock structure is formed by a knitting using the alternate needles, which is one of the characteristic feature of the invention. The construction of the present invention can produce the result that knit structure such as rib stitch or garter stitch that provides a reinforcing effect or an ornamental effect is formed in the three-dimensional shape knitted fabric. When this knit structure is formed in the fabric at desired locations, the fabric of a high commercial value can be provided.

BRIEF DESCRIPTION OF THE DRAWINGS

FIG. 1-B is a rear view of the same; and

FIG. 1-C is a sectional view of the same taken along line X—X of FIG. 1-A.

BEST MODE FOR CARRYING OUT THE INVENTION

The knitting method of a three-dimensional shape fabric of the present invention will be described with reference to the accompanying drawings. In the embodiments of the present invention, description is given on the knitting of a beret-use fabric by using a four-cam, two-bed, flat knitting machine wherein a pair of front and back needle beds are disposed to be opposed to each other and are so structured that the back needle bed can be moved laterally with respect to the front needle bed and also loops can be transferred between the front and back needle beds, and four cam units for forming and transferring the loops are arranged on carriages movable in reciprocation over the needle beds in a phase shift with respect to the traveling direction of the carriages. For the sake of simplicity of explanation, only a much smaller number of needles than practically used for the knitting are used in the following description.

Figure 1:
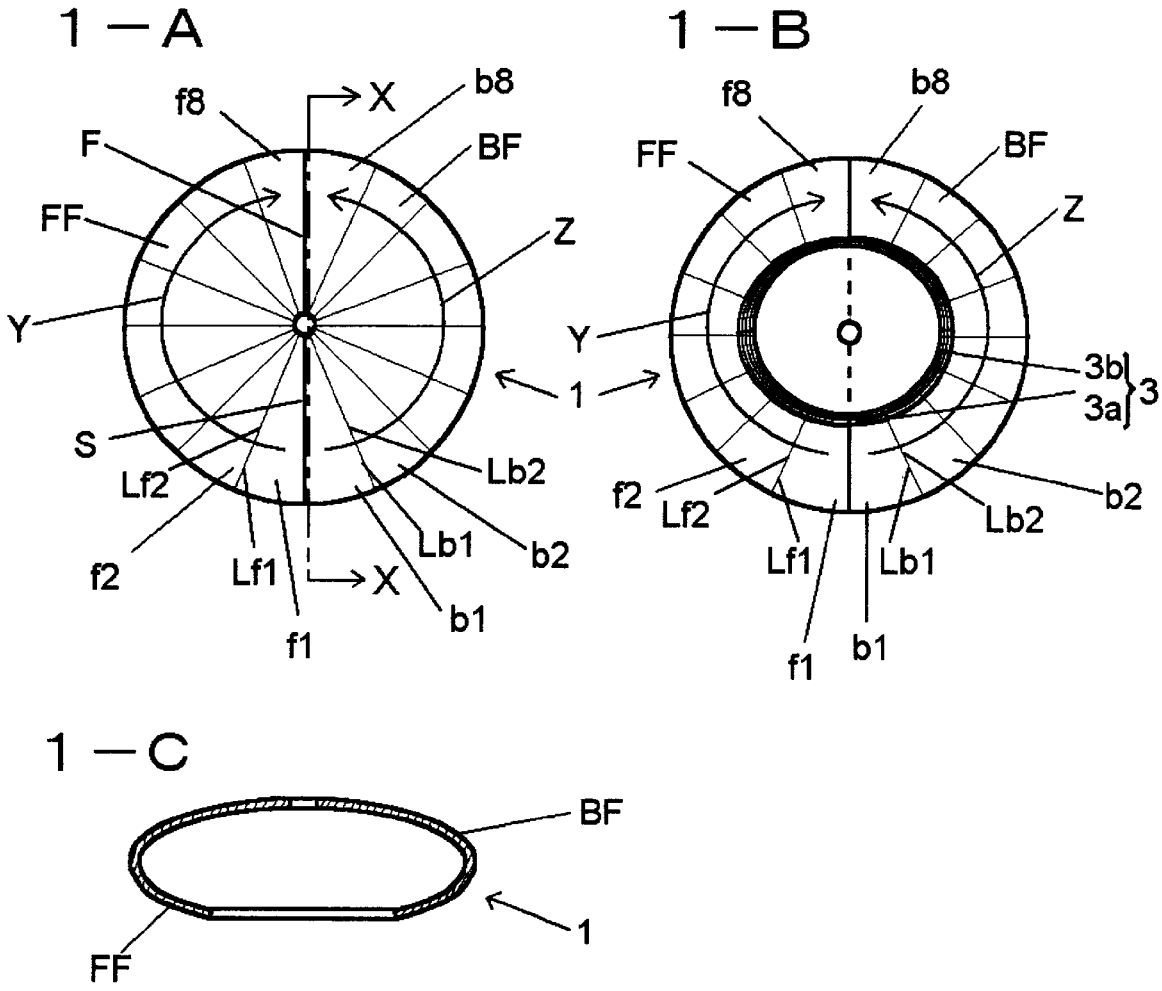
FIG. 1-A is a front view of a beret-use fabric.
Figure 2:
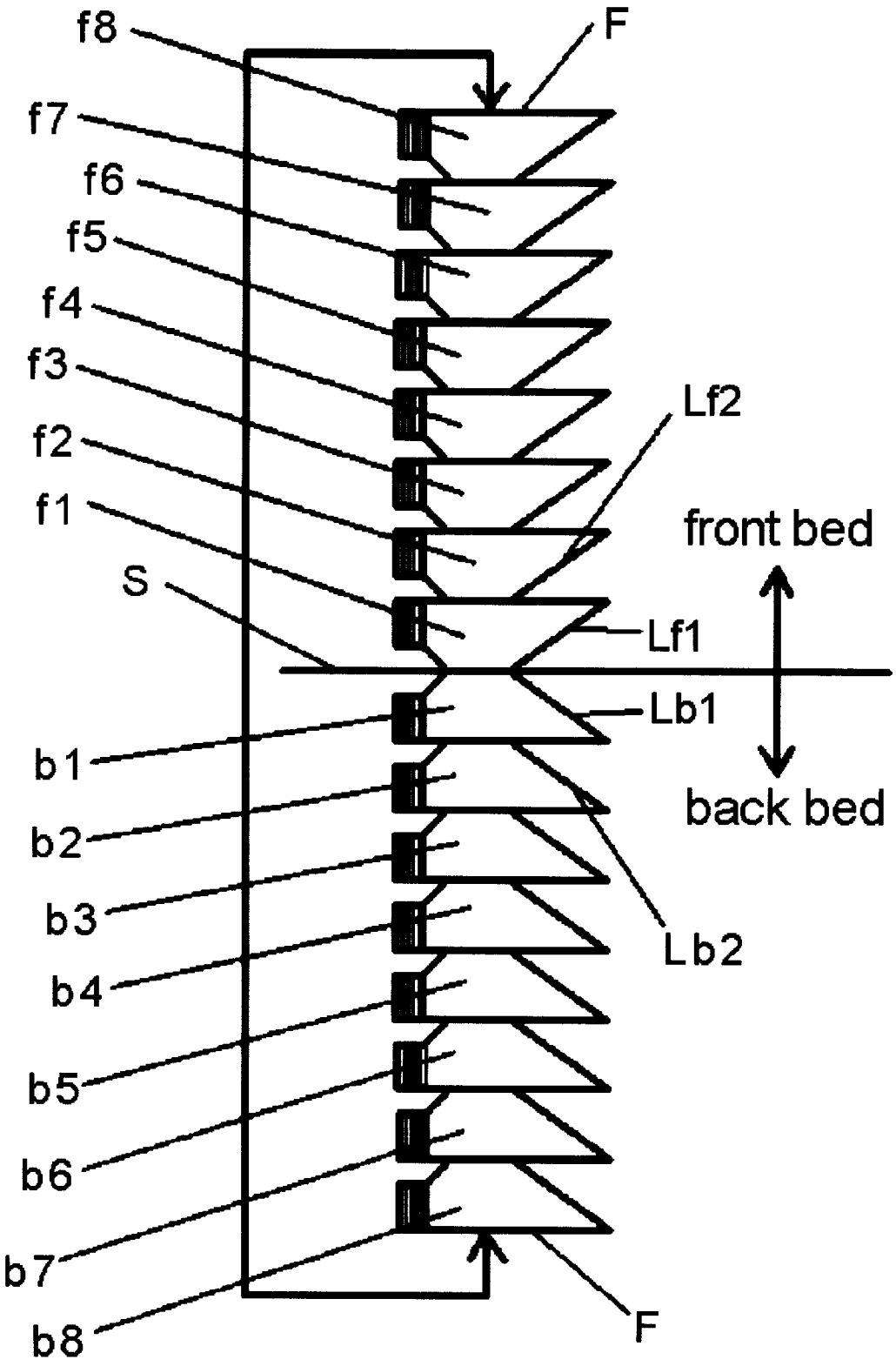
FIG. 2 is an illustration of the knitting of the beret-use fabric, wherein the knitting on the front bed is illustrated upwards and the knitting on the back bed is illustrated downwards from a starting point S of the knitting of the beret-use fabric as the center.
Figure 3:
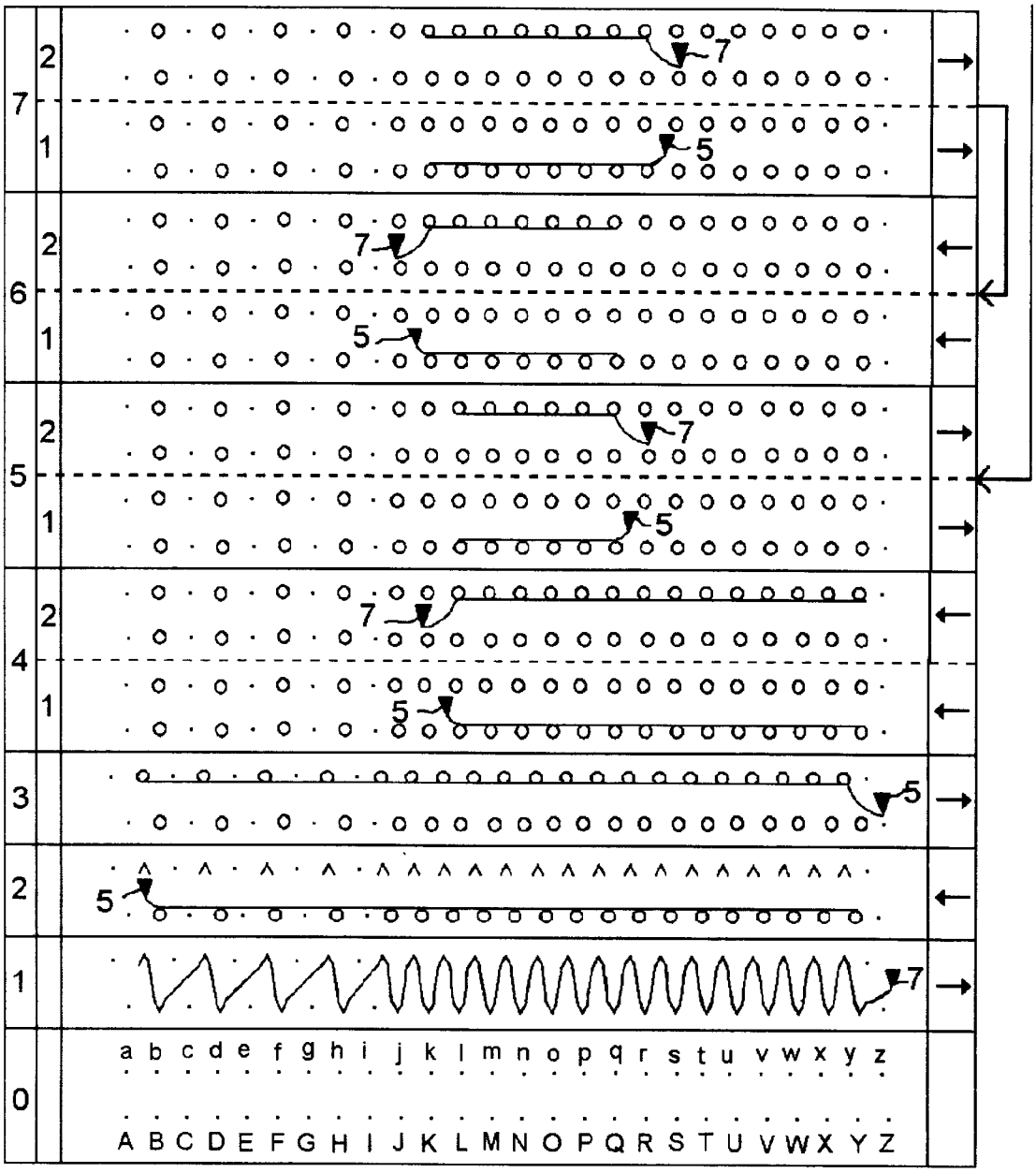
FIG. 3 is an illustration of knitting courses showing an embodiment of the present invention.
Figure 4:
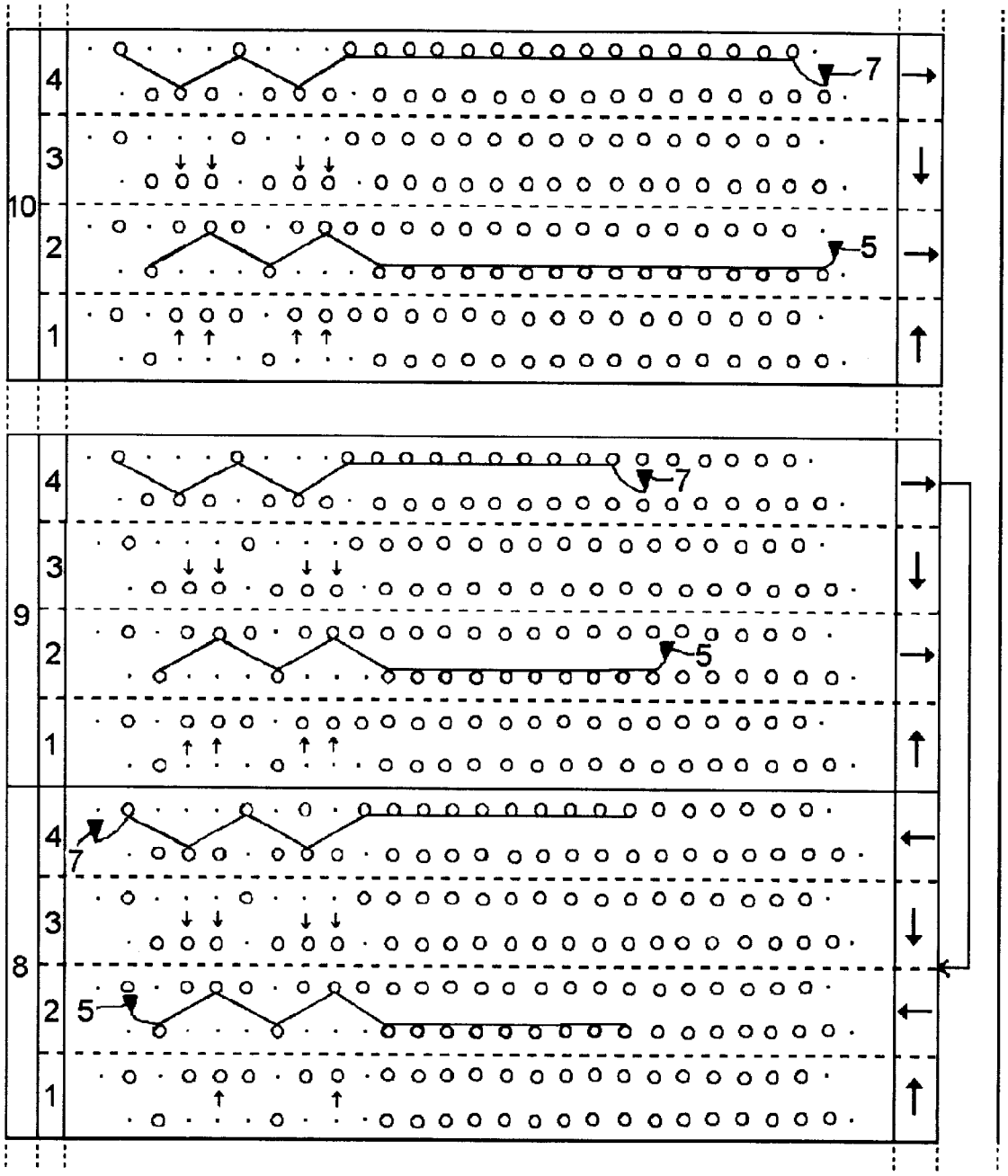
FIG. 4 is an illustration of knitting courses showing the embodiment of the present invention.
Figure 5:
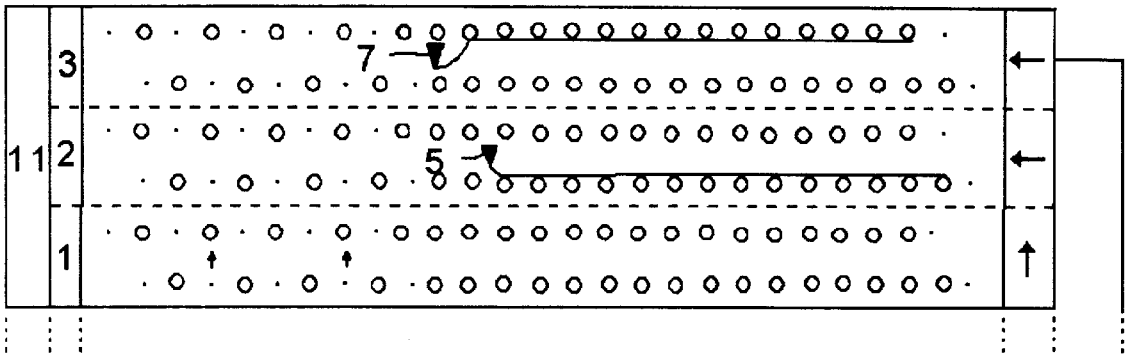
FIG. 5 is an illustration of knitting courses showing the embodiment of the present invention.

FIG. 1-A is a front view of a beret-use fabric formed by the knitting method of the embodiment; FIG. 1-B is a rear view of the same; and FIG. 1-C is a sectional view of the same taken along a chain line X—X of FIG. 1-A. S designates a starting point of the knitting of the beret-use fabric 1 and F designates a finishing point of the knitting of the same. FIG. 2 is an illustration of the knitting of the beret-use fabric 1, plotting the wale in vertical direction and the courses in horizontal direction, wherein the knitting on the front bed is illustrated upwards and the knitting on the back bed is illustrated downwards, with starting point S of the knitting as the center. FIGS. 3–5 are illustrations of knitting courses of the beret-use fabric 1.

The beret-use fabric 1 comprises a front fabric FF and back fabric BF. The front fabric FF is knitted in the direction of an arrow Y and the back fabric BF is knitted in the direction of an arrow Z. The front fabric FF and the back fabric BF are formed into a fabric into which their parts are joined, as shown in FIG. 2, by parts f1–f8 of the front fabric FF being continuously formed in order from a near side of the starting point S of the knitting of the parts and parts b1–b8 of the back fabric BF being continuously knitted in order from the near side of the starting point. The front fabric FF and the back fabric BF are joined to each other at the starting point S and the finishing point F of the knitting. The fabric has a rib-stitched hem portion 3 formed around a hem portion of its opening for the reinforcing purpose.

Referring to FIGS. 3–5 illustrating the knitting courses, the knitting of the beret-use fabric will be described. The numeric characters at the left side of the knitting course diagram of FIG. 3 designate the number of courses, and the numeric characters at the right side thereof designate the knitting performed by the 2nd, 3rd and 4th cam units in order from the 1st cam unit located upstream to downstream with respect to the traveling direction of the carriage. Horizontal arrows at the right side of the knitting course diagram indicate the traveling direction of the carriage and the vertical arrows indicate the transferring direction. Needles of the front needle bed are represented in capitals of alphabetical letters and needles of the back needle bed are represented in lowercase letters.

In the course 1 of FIG. 3, the knitting of the setup portion in which a yarn is fed to the alternate needles of the front and back needle beds is performed to knit the part f1 of the front fabric FF and the part b1 of the back fabric BF of FIG. 2. In the knitting of the setup portion, since the rib-stitched hem portion 3 is formed at the left end of the knitting region, the hem portion 3 is knitted with alternate needles as disclosed by Japanese Patent Publication No. Hei 3-75656 and the remaining portion is knitted with all needles without preparing any empty needle between the needles used for forming the loops. The knitting by use of alternate needles disclosed by Japanese Patent Publication No. Hei 3-75656 is a knitting method using a two-bed flat knitting machine having two needle beds disposed in back and forth to be opposed to each other wherein the knitting of the front fabric is allotted to odd needles and the knitting of the back fabric is allotted to even needles, so that the fabrics are knitted into a tubular form by use of alternate needles of the front and back needle beds. In this method, when the front fabric FF is knitted, the back fabric BF is associated with the needles of the back needle bed, while on the other hand, when the back fabric BF is knitted, the front fabric FF is associated with the needles of the front needle bed, so that the fabrics are knitted while they are kept in the condition of being overlapped back and forth. This enables the empty needles used for the transferring to be always reserved on the opposed needle bed. As a result of this, the fabrics having the structure pattern in which front stitches and back stitches are mixed, such as links, garter stitches and rib stitches, are knitted into the tubular form. When the stitch structure, such as garter stitches and rib stitches, is knitted into the tubular form, the needles of the both needle beds are used to knit the front fabric FF and the back fabric BF. When a reference is made to the time of the back fabric BF being knitted, the loops of the front fabric FF all come into the state of being retained at the needles of the front needle bed, which is referred to as being knitted in association with the front needle bed in the embodiment. On the other hand, when a reference is made to the time of the front fabric FF being knitted, the loops of the back fabric BF all come into the state of being retained at the needles of the back needle bed, which is referred to as being knitted in association with the back needle bed. The front fabric FF of the beret-use fabric 1 shown in FIG. 1 is knitted in association with the front needle bed and the back fabric BF is knitted in association with the back needle bed, so that the front fabric FF and the back fabric BF are knitted in the condition of being overlapped back and forth.

In the course 1 mentioned above, after the back needle bed is racked leftwards by 0.5 pitch of needle, a yarn is fed to the alternate needles B, D, F and H of the front needle bed and the alternate needles b, d, f, and h of the back needle bed through a front fabric knitting yarn feeder 7 in the left of the knitting region and also fed to the needles J to Y of the front needle bed and the needles j to y of the back needle bed in the right of the knitting region, so as to form a setup portion. In the course 2, the yarn is fed to the needles of the front needle bed retaining the knitting yarn by the knitting of the setup portion of the course 1, while also, in the course 3 the yarn is fed to the needles of the back needle bed retaining the knitting yarn through the yarn feeder 5 in the same manner, to form the loops in the setup portion. In the course 4, after the back needle bed is racked rightwards by 0.5 pitch needle, the yarn is fed to the needles Y to L in the center part of the knitting region from the right end of the knitting region through the front fabric knitting yarn feeder 5 by use of the first cam, to start the knitting of the part f1 of the front fabric FF and also the yarn is fed to the needles y to l through a back fabric knitting yarn feeder 7 by use of the second cam, to start the knitting of the part b1 of the back fabric BF. In the course 5, the carriage is reversed to reverse the yarn feeders resting in the center part of the knitting region in the knitting of the former course, so that the yarn is fed to the needles L to Q of the front needle bed through the first leading cam and the front fabric knitting yarn feeder 5 and the yarn is fed to the needles l to q of the back needle bed through the second cam and the back fabric knitting yarn feeder 7 in the same manner, so as to perform the flechage knitting. In the following, the knitting shown in the courses 6 to 7 are repeated, during which the knitting width is gradually widened from the center part of the knitting region to the both lateral sides while restoring the needles from the resting state from the course 5, to perform the flechage knitting.

Referring now to the course 8 and subsequent courses of FIG. 4, description will be given on the knitting of the part from which the rib-stitched hem portion 3 is started and of the subsequent parts. In the course 8, after the back needle bed is racked by one pitch of needle, the loops of the front fabric FF formed as the back stitches via the first cam are transferred to the confronting needles of the back needle bed, prior to the knitting of the front fabric FF. Then, the yarn is fed to the needles R to J and F and B of the front needle bed and the needles i and e of the back needle bed through the front fabric knitting yarn feeder 5 via the second cam. Sequentially, the loops of the front fabric FF formed on the back needle bed and the loops of the back fabric BF formed on the front needle bed as the back stitches are transferred to the confronting needles of the front needle bed via the third cam, prior to the knitting of the back fabric. Then, the yarn is fed to the needles r to j and f and b of the back needle bed and the needles G and C of the front needle bed through the back fabric knitting yarn feeder 7 via the fourth cam, to knit the back fabric BF. In the course 9, after the carriage is reversed, the loops of the back fabric BF formed on the front needle bed and the loops of the front fabric FF formed as the back stitches are transferred to the back needle bed via the first cam, prior to the knitting of the front fabric FF. Then, the yarn is fed to the needles B and F of the front needle bed, the needles e and i of the back needle bed, and the needles J to S of the front needle bed through the front fabric knitting yarn feeder 5 via the second cam, to knit the front fabric FF. Then, after the loops of the front fabric 1f formed on the back needle bed and the loops of the back fabric BF formed on the front needle bed as the back stitches are transferred to the confronting needles of the front needle bed via the third cam, the yarn is fed to the needles b and f of the back needle bed, the needles C and G of the front needle bed, and the needles j to s of the back needle bed through the back fabric knitting yarn feeder 7 via the fourth cam, to knit the back fabric BF. Subsequently, the knitting region is expanded rightwards while the knitting of the courses 8 and 9 are repeated and thereby the part f1 of the front fabric FF and the part b1 of the back fabric BF shown in FIG. 2 are formed.

After completion of the knitting of the parts f1 and b1, the knitting goes into the knitting of the part f2 of the front fabric FF and the part b2 of the back fabric BF. As shown in the course 11 of FIG. 5, in the knitting of the parts f2 and b2, the yarn is fed to the needles Y to L in the center part of the knitting region of the needles retaining the loops of the final courses of the parts f1 and b1 from the right end of the knitting region in the same manner as in the knitting of the parts f1 and b1 of the course 4 of FIG. 3, to initiate the knitting of the part f2 of the front fabric FF, and the yarn is fed to the needles y to l of the back needle bed via the second cam, to initiate the knitting of the part b1 of the back fabric BF. As a result of this, following the final course Lf1 of the part f1 and the final course Lb1 of the part b1, which were kept in the rested state, the loops Lf2 of the part F2 and the loops Lb2 of the part B2 are formed, so that the connection is made between the parts f1 and f2 and between the parts b1 and b2. Subsequently, the knitting returns to the course 5 of FIG. 3 and the same knitting as that of the part f1 and the part b1 is repeated for the remaining parts of the front fabric FF and the back fabric BF, to knit the front fabric FF from the part f1 to the part f8 and the back fabric BF from the part b1 to the part b8. Sequentially, after the loops of either of the front fabric FF and the back fabric BF are transferred to the opposite needle bed to superpose the loops of the front fabric FF and those of the back fabric BF, the yarn is fed to the needle located at one end of the knitting region in which the loops of the front fabric FF and those of the back fabric BF are held in the superposed state, to newly form a loop of the next course. Then, the newly formed loop is transferred to the confronting needle of the back needle bed. After the back needle bed is racked, the newly formed loop is transferred to the front needle bed, so as to be superposed on the loop of the adjacent wale. Then, the yarn is fed to the needles holding the loops of the final course of the front fabric FF and the loops of the final course of the back fabric BF and the needle holding the newly formed loops in the superposed state, to form the loops of the next course, so as to bind off the loops in the known manner. The bind-off process is repeatedly performed between one end side of the knitting region and the other end side to cast off the loops of the final courses of the front fabric FF and the back fabric BF and, thereafter, the front fabric and the back fabric are slipped from the needles. As a result of this, the final course of the front fabric FF and the final course of the back fabric BF are joined to each other to form the beret-use fabric 1 as shown in FIG. 1.

As mentioned above, in the knitting method of the embodiment of the present invention, the flechage knitting is performed in such a manner that the center part of the knitting region has an increased number of knitting courses and the both end parts thereof has a reduced number of knitting courses, so as to form the part whose center part is raised. Further, the parts are joined in order so that the front fabric FF and the back fabric BF can be knitted while they are kept in the condition of being overlapped back and forth. After the final course of the front fabric FF and the final course of the back fabric BF are joined, the bind-off process is performed. This knitting method of the embodiment of the present invention can produce a knitted fabric having a three-dimensional shape that could not be knitted by the conventional knitting method. In the knitting method of the embodiment of the present invention, since the fabric is divided into the plurality of parts and the divided parts are joined in order, to knit the knitted fabric, even when a spherical fabric is knitted, variation in number of knitting courses from one wale to another, which is caused by the flechage knitting, does not become large to such an extent that yarn breakage may occur in the loops in the knitting region put in the rested state. In addition, since the front fabric FF and the back fabric BF are both knitted in parallel, the same loops are prevented from being kept in the rested state for a long while. Consequently, there is little possibility of occurrence of the yarn breakage in the loops put in the rested state.

Further, in the knitting method of the embodiment of the present invention, the flat knitting machine having a plurality of knitting cam units permits both of the front fabric and the back fabric to be knitted in one operation of the carriage, for example, by knitting the front fabric FF via the leading cam system and the back fabric BF via the trailing cam system, thus providing improved efficiency in the knitting. Furthermore, since the knitting is performed by use of the both front and back needle beds, interlock structure such as rib-stitch structure or garter stitch structure, can be formed in the three-dimensional shape knitted fabric.

Figure 6:
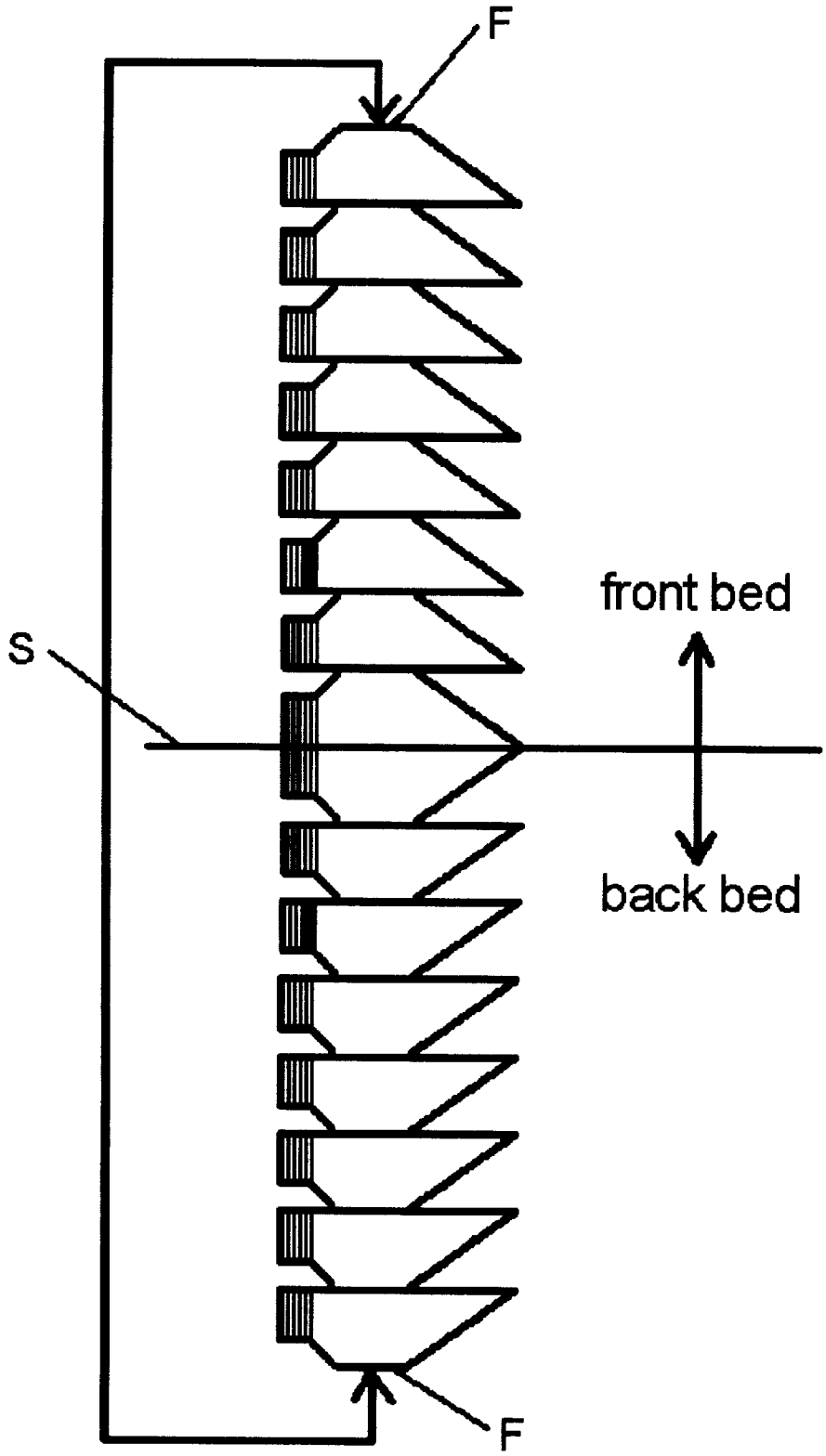
FIG. 6 is an illustration of the knitting of the fabric of another example of the embodiment, wherein the knitting on the front bed is illustrated upwards and the knitting on the back bed is illustrated downwards from a starting point S of the knitting of the beret-use fabric as the center.
Figure 7:
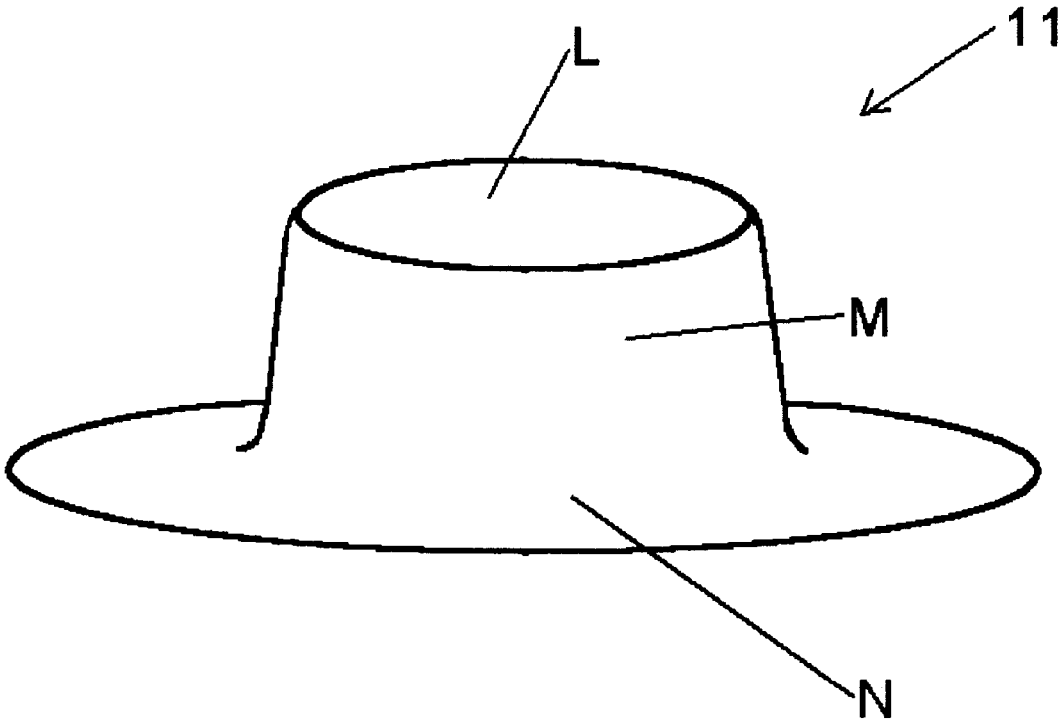
FIG. 7 is an illustration of a brimmed hat knitted in another embodiment of the present invention.
Figure 8:
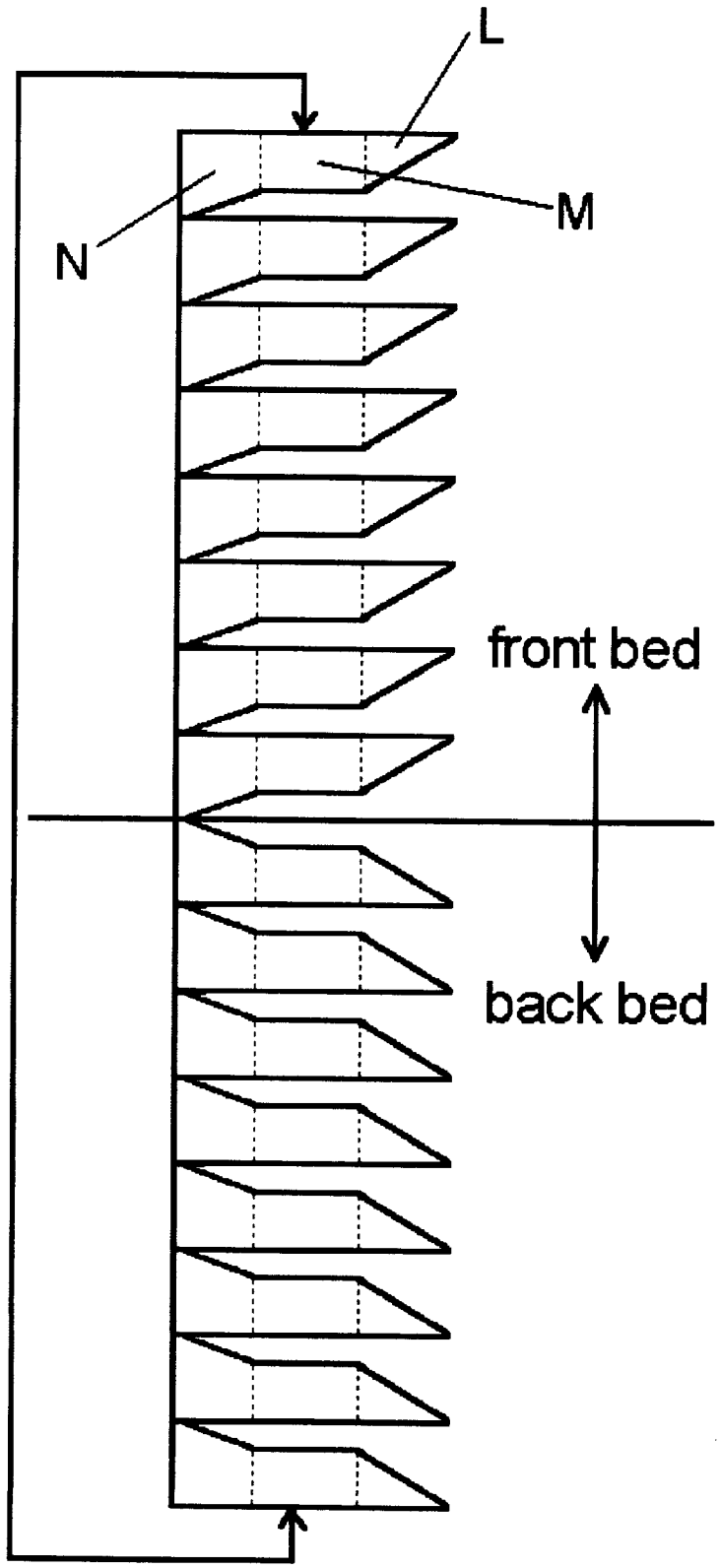
FIG. 8 is an illustration of the knitting of the brimmed hat of FIG. 7, wherein the knitting on the front bed is illustrated upwards and the knitting on the back bed is illustrated downwards from a starting point S of the knitting of the brimmed hat-use fabric as the center.

While in the embodiment described above, all the parts are knitted to widen their knitting widths in the flechage knitting, alteration may be adopted that all the parts are knitted to narrow their knitting widths, as shown in FIG. 6. Further, another alteration may be adopted that the knitting for the parts to be widened in knitting width and the knitting for the parts to be narrowed in knitting width are mixed. While in the embodiment described above, reference is given to the beret-use fabric 1 as shown in FIG. 1 as an example, the knitting method of the fabric of the present invention is applicable to the knitting of e.g. a brimmed hat 11 shown in FIG. 7, without limiting to the knitting of the beret-use fabric 1. The diagram of the knitting of the brimmed hat is shown in FIG. 8 which corresponding to FIG. 2. The brimmed hat 11 comprises three parts of a top-of-head part L, a side portion M and a sunshade portion N. In the knitting of the hat 11, following the knitting of the setup portions, the knitting of the first part of the hat is initiated from the outside of the sunshade portion by use of the both front and back needle beds. As the knitting of the sunshade portion proceeds toward the inside thereof continuing to the side portion of the hat, the knitting width of the same part is gradually increased. When the knitting width of the sunshade portion is sized up to its full width, the yarn is fed to the whole region of the side portion of the hat and then the knitting of the top-of-head portion of the hat is initiated from the outside thereof continuing to the side portion of the hat. Subsequently, the yarn is fed to the whole region of the sunshade portion and the side portion and also the top-of-head portion is knitted so that the knitting width thereof can be gradually widened from the outside to the inside. When the knitting width of the top-of-head portion is sized up to the whole region of the same, the knitting of the first part is completed. Subsequently, the same knitting as the knitting of the part mentioned above is repeatedly performed until the knitting of the eight parts is completed by use of the front needle bed and the back needle bed, whereby the brimmed hat shown in FIG. 7 is knitted. This knitting produces the brimmed hat 11 having the side portion M of a nearly even knitting width formed into a cylindrical form, the top-of-head portion L having a reduced number of knitting courses at the right side thereof when viewed in FIG. 8 and an increased number of knitting courses at the left side thereof, and the sunshade portion N formed as a plan orthogonal to the side portion M. It is to be noted that alteration may also be made in the knitting of the brimmed hat that all the parts are knitted to narrow their knitting widths, as is the case with FIG. 6. Further, another alteration may be made that the knitting for the parts to be widened in knitting width and the knitting for the parts to be narrowed in knitting width are mixed.

While in the embodiments described above, reference is given to the use of the flat knitting machine with four cams as an example, the present invention is not limited to any particular number of cams. The present invention can be practically applied to even the flat knitting machine having only a single knitting cam unit. While in the embodiments described above, reference is given to the use of the flat knitting machine of the type that the knitting cam provided on the carriage movable in reciprocation along the needle bed is brought into abutment with a back-and-forth movement controlling butt arranged in each knitting needle to controllably move the knitting needle back and forth, the present invention can also be practically applied to the flat knitting machine of the type that the individual needles are controllably moved back and forth by means of back-and-force movement control means such as a linear motor. While in the embodiments described above, reference is given to the use of the two-beds flat knitting machine having the pair of front and back needle beds as an example, the present invention can also be practically applied to a three-bed flat knitting machine or a four-bed flat knitting machine having an upper auxiliary needle bed(s) arranged over a pair of lower, front and back, needle beds. In the case where the four-bed flat knitting machine is used, even when the interlock structure, such as the rib-stitched structure, is knitted, since the front fabric is knitted by use of the needles of the lower front needle bed and the upper back needle bed and the back fabric is likewise knitted by use of the needles of the lower back bed and the upper front bed, there is no need to take the step that the front fabric are assigned to the odd needles and the back fabric to the even needles, for preparation of the empty needles for transference of the loops, as in the knitting of the interlock by use of the two-bed flat knitting machine, and thus even the parts in which the interlock structure is formed can be knitted by use of all the needles.

In the embodiment above referring to the knitting of the beret-use fabric 1 as an example, the front fabric FF and the back fabric BF are knitted into the form of their both ends opening. For example, when a spherical fabric used as a material of an airbag and the like is knitted, it may be knitted in such a manner that the yarn of the front fabric knitting yarn feeder and the yarn of the back fabric knitting yarn feeder can be crossed at one end of the knitting region or in such a manner that the parts are knitted in an alternate order, such as the part f1 of the front fabric FF→the part b1 of the back fabric BF→the part f2→the part b2 . . . Also, the number of knitting courses at both lateral end portions thereof may be reduced to a very small number to knit the three-dimensional shape fabric with the both ends dosed. When the fabric is knitted with its both ends dosed, a single yarn feeder may be used for both of the knitting of the front fabric FF and the knitting of the back fabric BF. The fabrics of a columnar form, cubic form and conical form can be knitted by the application of the knitting method of the embodiment of the present invention.

Capabilities of Explotation in Industry

As mentioned above, the knitting method of a three-dimensional shape fabric of the present invention can provide an improved efficiency in the knitting of the three-dimensional fabric. Further, since different cam systems are respectively used for the front fabric knitted in association with the front needle bed and the back fabric knitted in association with the back needle bed and also the front fabric and the back fabric are knitted in parallel with each other while they are kept in the condition of overlapping back and forth, the downward tensile force is not exerted on the same loops for a long while. Thus, the loops can be prevented from being brought to stretch by the downward tensile force or the yarn can be prevented from being broken by the downward tensile force.

When the flechage knitting is performed in such a manner that the front fabric knitting needles and the back fabric knitting needles are alternately arranged on the pair of front and back needle beds arranged in opposition to each other and also the knitting is performed in the condition in which the loops are retained on only either of the pair of confronting front and back knitting needles, for preparation of the empty needles for transference of loops on the confronting needle bed, the interlock structure, such as the rib stitches and the garter stitches, can be formed on the three-dimensional shape fabric.

What is claimed is:

1. A knitting method of a three-dimensional shape fabric whose front fabric and back fabric are knitted by use of a flat knitting machine, which comprises at least a pair of front and back needle beds, either or both of which are movable in a lateral direction thereof, and a plurality of cam systems, to transfer loops between the front needle bed and the back needle bed, and are joined at setup portions thereof and finishing portions thereof, the knitting method of the three-dimensional fabric comprising:

the step of forming the setup portion of the three-dimensional shape fabric by use of needles of the both front and back needle beds;

the step of knitting a non-rectangular front fabric and a non-rectangular back fabric by performing a flechage knitting in which a first part of the front fabric and a first part of the back fabric are varied in number of courses from one wale to another so as to put a part of loops into a rested state in the process in which the front fabric knitted in association with the front needle bed and the back fabric knitted in association with the back needle bed are knitted in parallel to each other by use of different cam systems;

the step of forming loops of the next parts following the forming of loops of final courses of the previously formed parts including the part of the loops as were put in the rested state, so as to join the parts to each other; and the step of superposing the loops of the final course of a final part of the front fabric and the loops of the final course of a final part of the back fabric on each other to perform a bind-off process.

2. The knitting method of a three-dimensional shape fabric according to claim 1, wherein an interlock structure is formed by a knitting using the alternate needles.

* * * * *